US011712883B2

(12) United States Patent
Joseph et al.

(10) Patent No.: US 11,712,883 B2
(45) Date of Patent: Aug. 1, 2023

(54) ROTOGRAVURE PRINTING

(71) Applicant: HP Indigo B.V., Amstelveen (NL)

(72) Inventors: Lior Joseph, Ness Ziona (IL); Regev Jekobson, Ness Ziona (IL); Erez Kopel, Ness Ziona (IL)

(73) Assignee: HP INDIGO B.V., Amstelveen (NL)

( * ) Notice: Subject to any disclaimer, the term of this patent is extended or adjusted under 35 U.S.C. 154(b) by 81 days.

(21) Appl. No.: 16/618,838

(22) PCT Filed: Jul. 14, 2017

(86) PCT No.: PCT/EP2017/067939
§ 371 (c)(1),
(2) Date: Dec. 3, 2019

(87) PCT Pub. No.: WO2019/011452
PCT Pub. Date: Jan. 17, 2019

(65) Prior Publication Data
US 2021/0107273 A1 Apr. 15, 2021

(51) Int. Cl.

| | |
|---|---|
| ***B41F 3/36*** | (2006.01) |
| ***B41F 9/06*** | (2006.01) |
| ***B41F 13/11*** | (2006.01) |
| ***B41M 1/10*** | (2006.01) |

(52) U.S. Cl.
CPC ..... *B41F 3/36* (2013.01); *B41F 9/063* (2013.01); *B41F 13/11* (2013.01); *B41M 1/10* (2013.01)

(58) Field of Classification Search
None
See application file for complete search history.

(56) References Cited

U.S. PATENT DOCUMENTS

| | | | |
|---|---|---|---|
| 6,155,166 | A | 12/2000 | Bertagna et al. |
| 6,843,762 | B2 | 1/2005 | Munche et al. |
| 8,096,239 | B2 | 1/2012 | Gelbart |
| 9,487,044 | B2 | 11/2016 | Hagspiel |
| 2003/0131743 | A1 | 7/2003 | Sauer et al. |
| 2004/0168593 | A1 | 9/2004 | Kasper et al. |
| 2013/0251905 | A1 | 9/2013 | Kelly |

FOREIGN PATENT DOCUMENTS

| | | | | |
|---|---|---|---|---|
| CN | 2597200 | Y * | 1/2004 | |
| CN | 2597200 | Y | 1/2004 | |
| CN | 101855087 | B * | 1/2015 | ..... B41F 27/005 |
| CN | 106716262 | A | 5/2017 | |
| DE | 1002003 | | 2/1957 | |
| DE | 102005029817 | | 3/2006 | |
| EP | 1132209 | | 9/2001 | |
| GB | 191203956 | | 8/1912 | |
| GB | 964463 | | 7/1964 | |

OTHER PUBLICATIONS

'Web Coating', Schaefer Machine Co., Inc., Retrieved from the Internet May 4, 2017. Available at: <http://www.schaeferco.com/about_rollcoaters.html>.

* cited by examiner

*Primary Examiner* — Joshua D Zimmerman

(57) ABSTRACT

In an example, a rotogravure printer roller is described. The printer roller (300) comprises a contact surface formed from a plurality of adjacent roller sections (302, 304). The roller sections are constructed and arranged to be removably assembled to form the roller.

14 Claims, 4 Drawing Sheets

ROTOGRAVURE PRINTING

BACKGROUND

Rotogravure printing processes form images on a print medium by transferring printing fluid from a printing fluid carrier roller, or rotogravure roller, to a print medium.

A printing fluid may be an image-forming fluid, such as an appropriate ink or colorant, or a primer, which may be applied to the print medium prior to applying the image-forming printing fluid to improve adhesion of image forming-printing fluid to the print medium. In some applications, such as label and packaging applications, it may desirable to omit primer from certain areas along the length of the print medium, for instance, to facilitate post-printing process such as stitching. Such un-primed areas may be referred to herein as 'lanes' and respective omission of primer from lanes may be used for so-called lane priming.

In so-called 'tinter' and so-called 'offset gravure' printing applications, lane priming may be achieved by removing portions of a rubber roller. Portions of the rubber roller that are in contact with other rollers in the printing system pick up and transfer printing fluid whereas portions of the rubber roller that are 'engraved' (i.e. meaning, in this context, regions where rubber has been 'removed') so that they are not in contact with other rollers in the printing system, do not collect and transfer printing fluid. In gravure printing processes, the opposite is true. In such processes, the roller is in direct contact with the print medium and the roller is composed of a non-absorbent material. In order to collect and transfer printing fluid, portions of the roller are engraved to provide volumes in which printing fluid is held for transfer to the print medium. Different sizes and depths of engraved volumes provide for different distributions and densities of printing fluid delivery.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1:
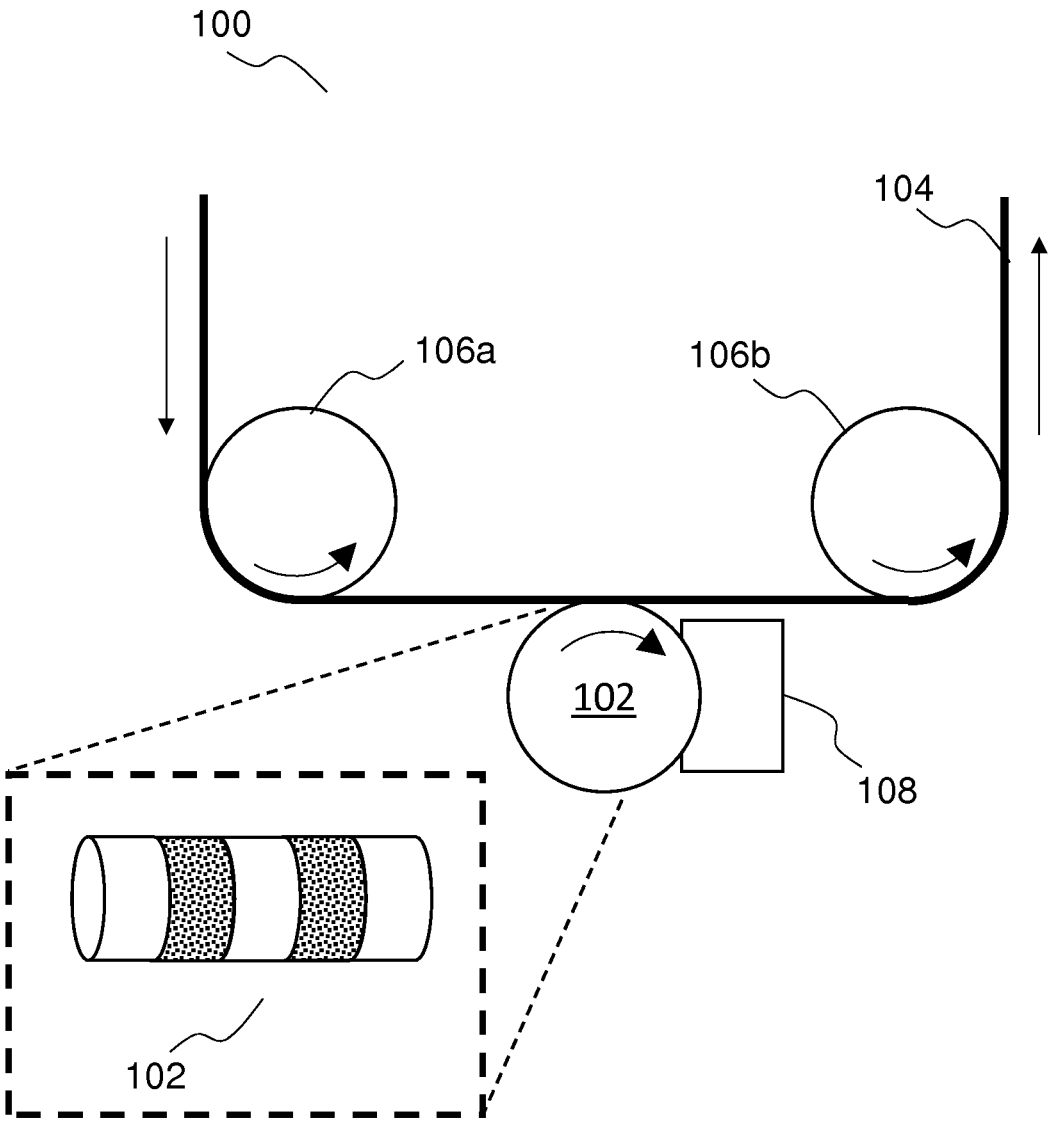
FIG. 1 is a schematic diagram of a rotogravure printer according to an example.

FIG. 1 illustrates components of a rotogravure print unit 100 according to an example. The print unit 100 comprises a rotogravure roller 102 (illustrated also in front view, inset) arranged to contact a print medium 104, which is held under tension by guide rollers 106*a*, 106*b*. The rotogravure roller 102 may be constructed according to an example, as will be described with reference to FIGS. 2 and 3.

The rotogravure roller 102 is, in some examples, partially immersed in a supply 108 of printing fluid as it rotates so as to pick up the printing fluid. In some examples, the printing fluid may be a primer for increasing or enabling adhesion of a further printing fluid to the print medium 104. In other examples, the printing fluid may comprise an ink or other colorant for forming an image on the print medium 104. In any event, the arrangement may comprise a scraper or squeegee (not shown) to assist in removing any unwanted or excess printing fluid from the rotogravure roller 102.

Figure 2:
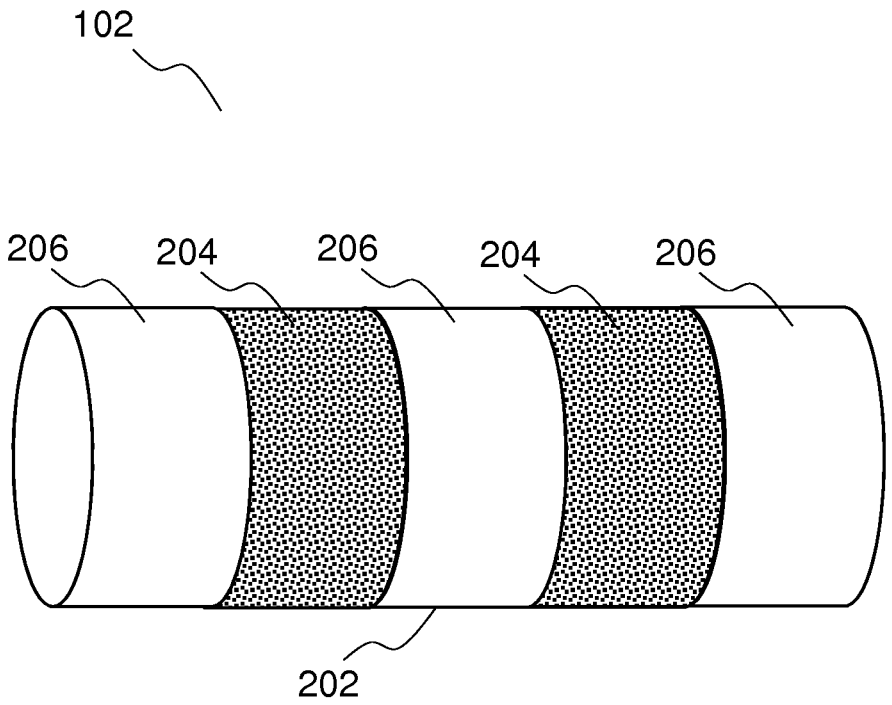
FIG. 2 is a schematic diagram of a rotogravure roller according to an example.

FIG. 2 illustrates a rotogravure roller 102, which may be constructed according to an example, as will be described with reference to FIG. 3. The rotogravure roller 102 may be, for example, an 'anilox' roller comprising a cylinder. For example, the cylinder may be formed of steel or aluminum and coated with a ceramic coating. Other appropriate materials may be used instead. The roller 102 comprises a contact surface 202 that, in use, contacts the print medium to selectively apply printing fluid to the print medium. The contact surface 202 comprises plural engraved regions 204 interspersed with one or more unengraved regions 206. The engraved regions 204 and unengraved regions have, generally, the same diameters. The unengraved regions 206 are relatively smooth and do not pick up printing fluid as efficiently as the engraved regions 204. Any printing fluid that is picked up by an unengraved region 206 may be removed by a scraper or squeegee (not shown) as has been explained. In this way, unengraved regions 206 do not transfer printing fluid to a print medium even when contact therewith is made.

The rollers used in typical rotogravure printing are relatively expensive to produce. In some examples, the rotogravure rollers are fabricated by laser etching the ceramic surface of the roller to form the cells in which printing fluid is collected and from which printing fluid is transferred to the print medium. Whereas, in applications that use rubber rollers, fabricating a new roller for each specific application is relatively cheap and easy, in rotogravure printing, fabricating an application-specific roller for each application (including, for example, one roller for priming and one for each primary printing color) represents a significant investment in terms of cost and fabrication time.

Figure 3:
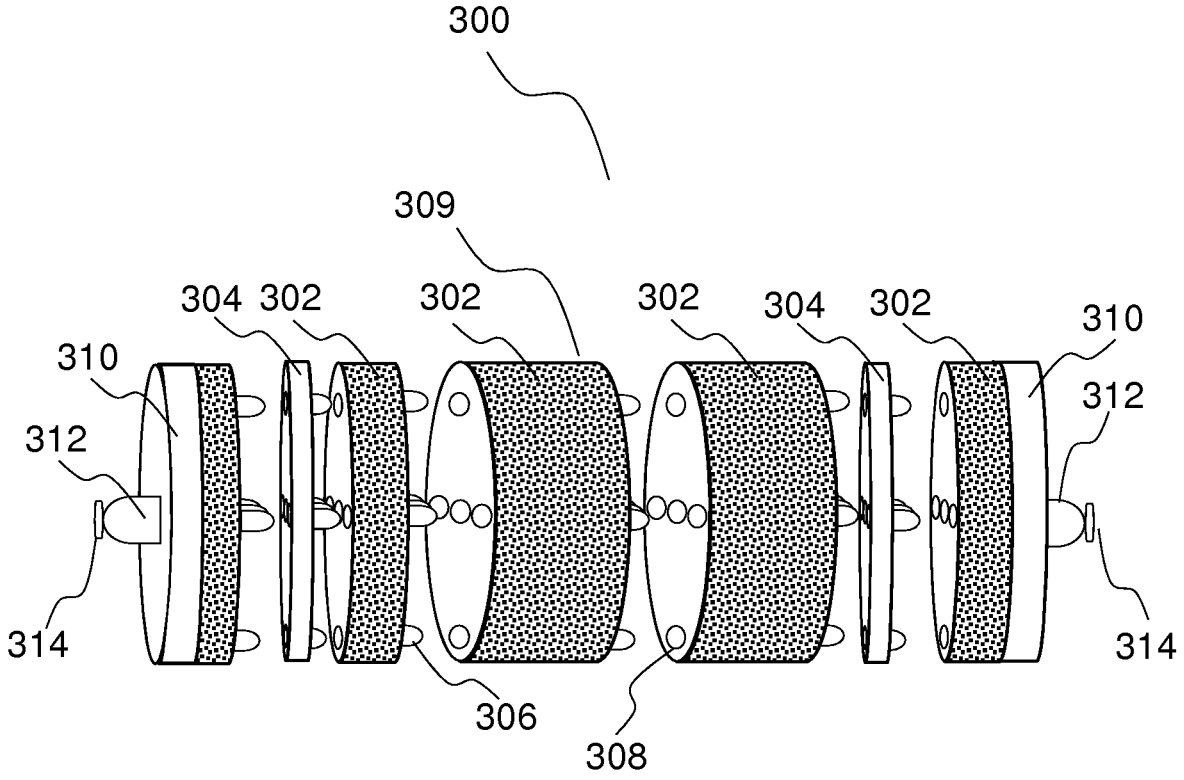
FIG. 3 is a schematic diagram of a modular arrangement of rotogravure roller sections according to an example.

FIG. 3 illustrates an exploded view of an example of a rotogravure roller 300 constructed and arranged according to an example. The rotogravure roller 300 has a modular arrangement comprising at least one engraved section 302 of roller and at least one unengraved section 304 of roller, the latter of which is or are also referred to herein as lane sections. In examples, there may be plural engraved sections 302 of roller and/or plural unengraved sections 304 of roller. For example, there may be at least two unengraved sections 304. In the example shown, there are five engraved sections 302 and two relatively narrow unengraved sections, which, when abutted together, form the roller. The example in FIG. 3 may be suitable as a roller for priming including lane priming, wherein the lanes are formed by the unengraved sections 304.

Each section (or 'module') has a generally cylindrical form, having spaced-apart, parallel, circular opposing faces connected by an outer circumferential or perimeter contact surface region. The circular opposing faces of each section have generally the same diameter dimensions. The outer circumferential or perimeter contact surface regions have an axial width dimension, which can vary from one section to another according to need. When the sections are abutted in a widthwise (i.e. end-to-end) fashion they form a desired construction of rotogravure roller 300, having a constant diameter. However, the width of each section may vary, for example, so that one or more unengraved sections 304 are positioned, or spaced apart by a desired amount (e.g. to facilitate lane priming), by an appropriate arrangement of intermediate engraved sections 302 (or vice versa). The width of each section may be selected so that, when abutted, the sections form a predetermined overall width, which fits into the rotogravure print unit 100. In an alternative example, the rotogravure print unit 100 may be adapted to accommodate different widths and make-ups of rotogravure roller 300, to match, for example, different widths of print media.

Each section may be formed of steel or aluminum and coated with a ceramic coating. Other appropriate materials may be used instead. The engraved regions 302 may comprise many cells, which are each arranged or formed to hold a volume of printing fluid. The cells may be formed, for example, by laser etching of the contact surface, or may be formed, for example, by using materials, such as ceramic coatings, which have surfaces forming dimples or cells naturally. Other ways of forming an engraved surface comprising cells or equivalent for holding a volume of printing fluid is encompassed within the scope of 'engraved' according to the present examples. Portions of the surface 202 containing cells are able to collect, retain and then impart or transfer printing fluid to a print medium when arranged in a unit, for example, according to FIG. 1.

According to an example, each of the sections 302, 304 comprise at least one alignment feature 306, 308. As shown in FIG. 3, alignment features are on each of the opposing faces of a section, for aligning the respective section with an adjacent section. As shown, each section may have plural such alignment features. In an example, on one side of each section 302, 304, there are one or more protrusions 306 (to engage with respective recesses on neighboring or adjacent sections) and, on the opposing side of each section 302, 304, there are one or more recesses 308 (to engage with respective protrusions 306 on neighboring or adjacent sections).

The protrusions may take any appropriate form and could be, without limitation, projections, pillars, poles or bumps. Correspondingly, the recesses may take any appropriate form and could be, without limitation, pockets, detents, crevices or holes. In some examples, one side of a section may accommodate alignment features comprising a mix of protruding and recessed features, which are arranged to marry with corresponding recessed and protruding features of an adjacent section.

The protrusions 306 and recesses 308 are arranged to correspond and engage with one another so as to enable alignment of one section 302, 304 with another section 302, 304, when sections 302, 304, are abutted. In particular, the protrusions 306 and recesses 308 are arranged to align an outer contact surface 309, or outer perimeter, of each of the sections 302, 304 of the roller 300. In addition, the protrusions 306 and/or recesses 308 of one section, when mated with the respective protrusions 306 and/or recesses 308 of an adjoining section, cause any rotational motion of one section to transfer to the adjoining section. In this way, all sections forming the rotogravure roller 300, in use, rotate as a single roller.

According to an example, as illustrated in FIG. 3, an arrangement of modular sections forming a rotogravure roller 300 are bounded at each end by an end plate 310. In the example, the end plates have a disk-like form and have a diameter dimension generally the same as that of the bounded engraved and unengraved sections. The outer, circumferential surfaces of the end plates may be unengraved, so as not to interfere with printing. Moreover, although not shown, each end plate has an inner face, facing an outer face of an outer section, and includes alignment features arranged to marry with the alignment features of the outer section. In this way, the end plates remain aligned with the sections and any rotational motion imparted by or via an end plate causes the end plates to rotate as one roller with the modular elements.

According to an example, as illustrated in FIG. 3, each end plate has a shaft portion 312. When the rotogravure roller 300, comprising plural modular sections 302, 304 and end plates 310, has been assembled, the shaft portions of the end plates 310 are arranged to engage with a mounting structure (not shown) of a respective print unit 100. The shaft portions and mounting structure may comprise corresponding bearing surfaces 314 to facilitate rotation of the roller relative to the mounting structure. The mounting structure may, in addition, or alternatively, include roller bearings to support the roller and facilitate rotation. The or each shaft portion 312 may be configured to engage with a drive mechanism of the mounting structure, whereby rotational motion may be imparted to the rotogravure roller 300 from the drive mechanism.

In other examples, the end plates may have a diameter less than the other sections, and/or may take another form, and may not as such form a part of the contact surface of the respective roller. In other examples, the end plates may have an engraved peripheral surface and form a part of the overall contact surface 202 of the roller. In other examples, the end plates may have a combination of engraved (e.g. innermost) and unengraved (e.g. outermost) sections and form a part of the overall contact surface 202 of the roller. Any combination of different kinds of end plate may be used, as dictated by need.

In yet other examples, each of the modular sections has a central axial hole such that the sections can be mounted along an axle, which rotationally engages with the print unit 100. The sections may have alignment features, of the kind that are illustrated in FIG. 3, that serve to impart rotational motion from one section to another, whereas circumferential alignment is delivered by the axle. Alternatively, the axial holes of the sections and the axle may be complimentarily shaped so that rotation of the axle, driven by a drive mechanism, causes rotation of the sections. For instance, the axle may have a triangular, square or hexagonal cross section to mechanically engage with matching cross-sections of axial hole in the sections. In such examples, the axle serves to align the sections and impart rotational motion to all sections and the shape of the axial holes serves as an alignment feature of the sections. Some such arrangements may include end plates. In such arrangements, the axle may be located between the end plates, whereby the end plates engage with a mounting frame as explained above, or may pass through the end plates and itself engage with the mounting structure.

According to examples, the modular sections may be provided in kits, in both engraved and unengraved variants, and including end plates. The modular sections may have various different axial widths and, for engraved variants, various different kinds of engraving (e.g. different depths of engraving to deliver different densities of printing fluid). The unengraved sections may be provided in one or more widths (e.g. 10 mm) that are appropriate for lane priming. The engraved variants may be provided in one or more widths (e.g. 5 mm, 10 mm, 20 mm, 50 mm, 100 mm), individually or in combination, for spacing apart the unengraved variants. In addition, a single engraved section, having a width (e.g. 330 mm) equaling that of the entire roller, may be provided when no lane priming is to be performed. If one or more of the end plates include engraved regions (e.g. 5 mm wide), that can form part of the contact surface, then a single engraved section can be commensurately less wide (e.g. 320 mm). Alternatively, if no lane priming is to be performed, a single roller may be formed comprising plural engraved sections having a combined width equaling that of the entire roller.

Using a selection of appropriate individual modular sections from kits or otherwise it is possible to form a rotogravure roller 300 having a pre-determined make-up and width (s) of engraved and (where present) unengraved sections. Such rollers may be disassembled and assembled into different patterns readily to allow for plural different impositions, without the need to manufacture a new single-piece, bespoke roller for each purpose.

Figure 4:
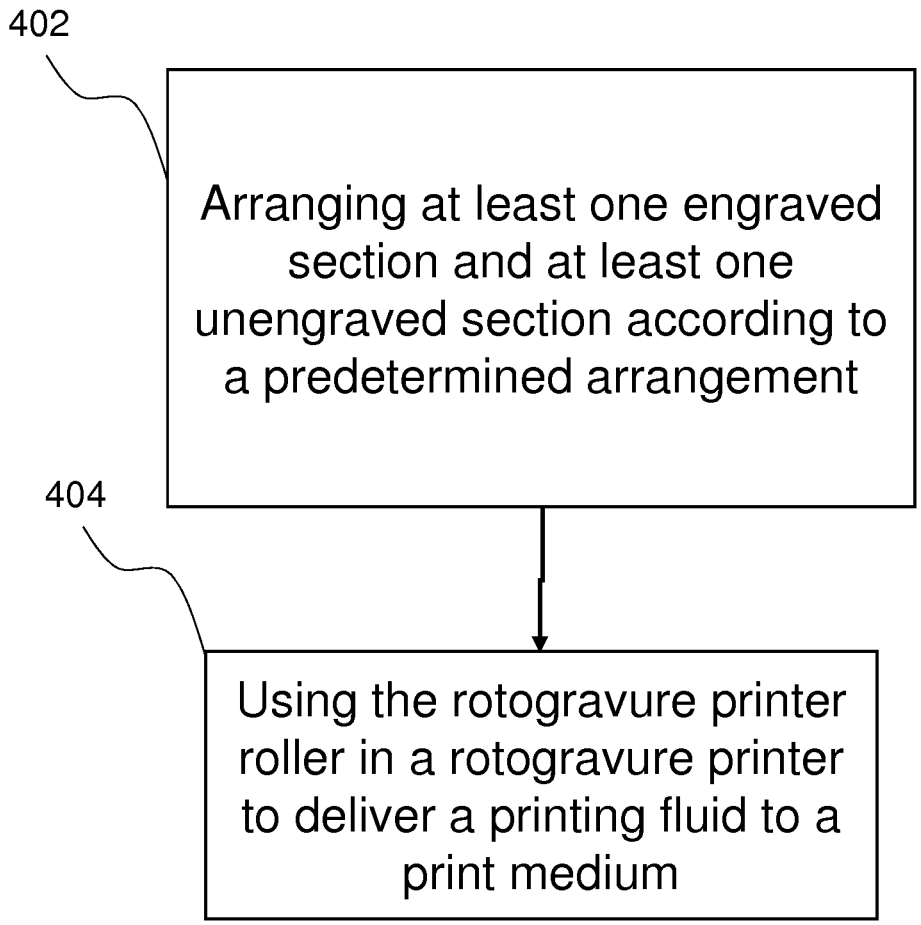
FIG. 4 is a flow diagram showing a method of operating a rotogravure printer according to an example.

FIG. 4 is a diagram illustrating a method 400 according to an example. At block 402 a plurality of engraved sections and unengraved sections are arranged according to a predetermined arrangement to provide printing fluid to a print medium. The method according to block 404 may include using the roller to deliver printing fluid to a print medium.

The preceding description has been presented to illustrate and describe examples of the principles described. This description is not intended to be exhaustive or to limit these principles to any precise form disclosed. Many modifications and variations are possible in light of the above teaching. Features from any example, within practical limits, may be combined with features from any other example.

What is claimed is:

1. A rotogravure printer roller comprising:

a plurality of roller sections that each include a first face that includes a plurality of protrusions and a second face that includes a plurality of recesses;

a contact surface formed from the plurality of roller sections, wherein the plurality of roller sections are removably assembled to form the rotogravure printer roller when the plurality of protrusions from a first section are positioned within the plurality of recesses of a second section that is adjacent to the first section; and an end plate that includes an outer face with a shaft portion and an inner face with alignment features arranged to connect with an alignment feature of an outer roller section of the rotogravure printer roller, wherein the shaft portion of the end plate does not extend to the inner face of the end plate.

2. The rotogravure printer roller according to claim 1, comprising at least one engraved roller section and at least one unengraved roller section, wherein the contact surface comprises respective engraved and unengraved regions.

3. The rotogravure printer roller according to claim 2, wherein the engraved regions and unengraved regions of the contact surface are to facilitate lane priming in use.

4. The rotogravure printer roller according to claim 1, wherein each section comprises a corresponding alignment feature to align a respective section with an adjacent section.

5. The rotogravure printer roller according to claim 1, wherein the shaft portion is to engage with a drive mechanism of a mounting structure.

6. The rotogravure printer roller according to claim 1, comprising a bearing surface, the bearing surface to engage a corresponding bearing surface of a rotogravure printer.

7. A modular section for a rotogravure printer roller, the modular section comprising:

a first face that includes a plurality of protrusions and a second face that includes a plurality of recesses, the plurality of protrusions integrally formed on the first face and the second face excluding protrusions;

a peripheral contact surface to engage a print medium, the plurality of protrusions and the plurality of recesses arranged along inner surfaces of the first face and the second face spaced from the peripheral contact surface; and an alignment feature having the plurality of protrusions to align the modular section with an adjacent modular section of the rotogravure printer roller when the plurality of protrusions from the modular section are positioned within a plurality of recesses of the adjacent modular section, wherein the plurality of recesses on the second face connects to a corresponding alignment feature of another adjacent modular section, which is coupled to an inner surface of an end plate that includes a shaft portion on an outer surface, wherein the shaft portion of the end plate does not extend to the inner surface of the end plate.

8. The modular section according to claim 7, wherein the contact surface is an engraved surface to engage a print medium and transfer a printing fluid to the print medium.

9. The modular section according to claim 7, wherein the contact surface is an unengraved surface to engage a print medium, the unengraved surface being to prevent or limit transfer of a printing fluid to the print medium.

10. A modular rotogravure printer roller comprising a plurality of modular sections according to claim 7.

11. A kit comprising a plurality of modular sections according to claim 7, wherein the kit comprises a modular section having an engraved contact surface and a modular section comprising an unengraved contact surface.

12. The kit according to claim 11 further comprising two end plates.

13. A method of operating a rotogravure printer, the method comprising:

providing a rotogravure printer roller by arranging an engraved roller section that includes a first face with a plurality of protrusions and an unengraved roller section that includes a second face that includes a plurality of recesses such that the plurality of protrusions of the first face are positioned within the plurality of recesses of the second face;

providing a first end plate on a first end of the rotogravure printer roller that includes a first shaft portion to engage with a drive mechanism, wherein the first shaft portion of the first end plate does not extend to an inner face of the first end plate; and providing a second end plate on the second end of the rotogravure printer roller that includes a second shaft portion to engage with the drive mechanism, wherein the second shaft portion of the second end plate does not extend to an inner face of the second end plate.

14. The method according to claim 13, including using the rotogravure printer roller in a rotogravure printer to deliver a printing fluid to a print medium.

* * * * *